US007789073B2

(12) United States Patent
Miyake et al.

(10) Patent No.: US 7,789,073 B2
(45) Date of Patent: Sep. 7, 2010

(54) FUEL INJECTION CONTROL APPARATUS

(75) Inventors: Takao Miyake, Hitachinaka (JP); Masahiro Toyohara, Hitachiohta (JP); Takuya Mayuzumi, Hitachinaka (JP); Tohru Ishikawa, Kitaibaraki (JP); Ryoichi Oura, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/339,496

(22) Filed: Dec. 19, 2008

(65) Prior Publication Data

US 2009/0177369 A1 Jul. 9, 2009

(30) Foreign Application Priority Data

Jan. 7, 2008 (JP) ..... 2008-000825

(51) Int. Cl.
*F02M 51/00* (2006.01)

(52) U.S. Cl. ..... 123/490; 123/482

(58) Field of Classification Search ..... 123/478, 123/482, 490

See application file for complete search history.

(56) References Cited

U.S. PATENT DOCUMENTS

| | | | | |
|---|---|---|---|---|
| 4,922,878 | A * | 5/1990 | Shinogle et al. | 123/490 |
| 5,053,911 | A * | 10/1991 | Kopec et al. | 361/154 |
| 5,341,032 | A * | 8/1994 | Brambilla et al. | 327/110 |
| 5,701,870 | A * | 12/1997 | Gottshall et al. | 123/490 |
| 5,825,216 | A * | 10/1998 | Archer et al. | 327/110 |
| 5,940,262 | A * | 8/1999 | Archer | 361/155 |
| 5,959,825 | A * | 9/1999 | Harcombe | 361/154 |
| 5,986,871 | A * | 11/1999 | Forck et al. | 361/160 |
| 6,175,484 | B1 * | 1/2001 | Caruthers et al. | 361/159 |
| 6,188,562 | B1 * | 2/2001 | Lutz et al. | 361/154 |
| 6,584,961 | B2 * | 7/2003 | Marceca et al. | 123/490 |
| 6,892,708 | B2 * | 5/2005 | Nasu | 123/490 |
| 7,013,876 | B1 | 3/2006 | Puckett et al. | |
| 7,245,474 | B2 * | 7/2007 | Bolz et al. | 361/154 |
| 7,578,284 | B2 * | 8/2009 | Mayuzumi et al. | 123/490 |
| 7,621,259 | B2 * | 11/2009 | Mayuzumi | 123/490 |
| 2003/0010325 | A1 * | 1/2003 | Reischl et al. | 123/490 |

(Continued)

FOREIGN PATENT DOCUMENTS

EP 0 727 566 A2 8/1996

(Continued)

OTHER PUBLICATIONS

European Search Report dated May 12, 2009 (Five (5) pages).

*Primary Examiner*—Hai H Huynh
(74) *Attorney, Agent, or Firm*—Crowell & Moring LLP

(57) ABSTRACT

A fuel injection control apparatus is capable of reducing a minimum quantity of fuel injection without reducing a maximum quantity of injection. To open a fuel injector valve, a driving circuit supplies an electric current from a high-voltage power supply to the fuel injector. Then, after valve opening, the high-voltage power supply is switched to a low-voltage power supply, and an open state of the valve is retained. For opening the valve of the fuel injector, a microcomputer, after supplying current from the high-voltage power supply to the injector, discharges the current rapidly for a decrease below a first current level at which the open state of the valve cannot be retained. The microcomputer then controls the supply current to the injector so as to supply a current at a second current level at which the open state of the valve can be retained.

2 Claims, 9 Drawing Sheets

U.S. PATENT DOCUMENTS

| | | | | |
|---|---|---|---|---|
| 2003/0188717 | A1 * | 10/2003 | Aubourg | 123/490 |
| 2009/0217914 | A1 * | 9/2009 | Casasso | 123/490 |

FOREIGN PATENT DOCUMENTS

| | | | |
|---|---|---|---|
| EP | 1 179 670 | A1 | 2/2002 |
| JP | 3562125 | B2 | 6/2004 |
| JP | 3768723 | B2 | 2/2006 |
| WO | WO 2008/009313 | A1 | 1/2008 |

* cited by examiner

FUEL INJECTION CONTROL APPARATUS

BACKGROUND OF THE INVENTION

1. Field of the Invention

The present invention relates generally to fuel injection control apparatuses of internal combustion engines, and more particularly, to a fuel injection control apparatus capable of improving its minimum fuel injection quantity.

2. Description of the Related Art

Internal combustion engines have a fuel injection control apparatus that computes the appropriate quantity of fuel according to a particular operational state and drives a fuel injector used to supply the fuel. The fuel injector opens or closes its valve, part of the injector, by utilizing the magnetic force generated by the flow of current through a solenoid, and thus injects the fuel or stops the injection. The quantity of fuel injected is determined primarily by the differential between the pressure of the fuel and the atmospheric pressure of the injector nozzle and the time during which the valve is maintained in the open state and the fuel is injected. To inject the appropriate quantity of fuel, therefore, it is necessary that the appropriate time for maintaining the open state of the injector valve be assigned according to a particular fuel pressure and that the valve be opened or closed rapidly and accurately.

In this case, delay in the response of the current circuit causes the closing operation of the injector valve to be completed with a delay behind the timing in which the fuel injection control apparatus intends to make the injector close the valve. When the driving pulse Ti applied to the injector is long, a departure of the injection quantity from its desired value due to the delay in the closing of the valve can be avoided by preassigning a power distribution time minus the valve-closing delay. When the duration of power distribution to the injector is short, however, setting the power distribution time minus the valve-closing delay leads to the injector valve starting to close before it fully opens; thus, the quantity of fuel requested cannot be injected accurately.

Accordingly, in a known technique (see, for example, Japanese Patent No. 3768723), the dynamic range of fuel control quantities is expanded by variably adjusting the over-excitation period at an early stage of the opening operation of the injector valve to a minimum requirement according to the pressure of the fuel injected from the injector.

In another known technique (see, for example, Japanese Patent No. 3562125), before an injection pulse signal period of the minimum pulse width terminates, the solenoid current of the injector is forcibly reduced to a valve-open state retention current level within a short time to proportionate the injection quantity to the injection pulse width, thus controlling the injection quantity accurately.

SUMMARY OF THE INVENTION

In recent years, reduction in the idling speeds of internal combustion engines has been required in terms of reduction in fuel consumption rate, and a demand for the minimum quantity of fuel which can be injected from fuel injectors tends to be decreasing. Likewise, the chances of fuel cuts for not injecting the fuel when motive power output of the internal combustion engine is unnecessary are increasing for reduction in fuel consumption rate, and this tendency is, in turn, increasing the frequency of resumption of fuel injection. Resuming fuel injection requires injecting a small quantity of fuel equivalent to a no-load state. Also, split injection is used for increased output and/or for improved exhaust performance. Split injection is intended to improve the performance of the internal combustion engine by injecting timely in multiple split shots the necessary quantity of fuel which is to be originally injected in one shot. During split inspection, the fuel injection quantity per shot is required to be reduced.

Attempts to improve the fuel consumption rates in motor vehicles each equipped with a downsized internal combustion engine have also been made. In this case, since the improvement of specific output is called for, the foregoing reduction in the minimum injection quantity and an increase in the maximum injection quantity are also required. Therefore, the dynamic range required of the fuel injector, that is, the value obtained by dividing the maximum injection quantity by the minimum injection quantity tends to increase.

In order to meet such a demand for the improvement of internal combustion engines in performance, fuel injectors are required to be able to inject a small quantity of fuel without reducing the maximum injection quantity. There has been the problem, however, that the methods described in Japanese Patent No. 4768723 and 3562125 do not suffice to meet the minimum fuel injection quantity required.

An object of the present invention is to provide a fuel injection control apparatus capable of reducing a minimum quantity of fuel injection without reducing a maximum quantity of fuel injection.

(1) In order to attain the above object, the present invention provides as an aspect thereof: A fuel injection control apparatus for use in an internal combustion engine, constructed to supply electric current from a high-voltage power supply to a fuel injector in order to open a valve of the injector, then after opening the valve, switch the high-voltage power supply to a low-voltage power supply, and retain the open state of the valve, the control apparatus comprising control means for controlling the current supplied to the fuel injector such that after the current is supplied from the high-voltage power supply to the fuel injector to open the valve of the injector, the current is rapidly discharged to reduce the current to a first current incapable of keeping the valve open or below, and a second current capable of keeping the valve open is then supplied to the fuel injector.

This configuration allows the system to reduce the minimum quantity of fuel injection without reducing the maximum quantity of fuel injection.

(2) In the above item (1), after reducing the current to the first current incapable of keeping the valve open or below, the control means preferably retains the first current or below for a predetermined amount of time.

(3) In the above item (1), after reducing the current to the first current incapable of keeping the valve open or below, the control means preferably retains a third current higher than a current capable of keeping the valve open for a predetermined amount of time and then supplies the second current.

According to the present invention, the minimum quantity of fuel injection can be reduced without reducing the maximum quantity of fuel injection.

DESCRIPTION OF THE PREFERRED EMBODIMENTS

A configuration and operation of a fuel injection control apparatus according to a first embodiment of the present invention will be described hereunder using FIGS. 1 to 8.

Figure 1:
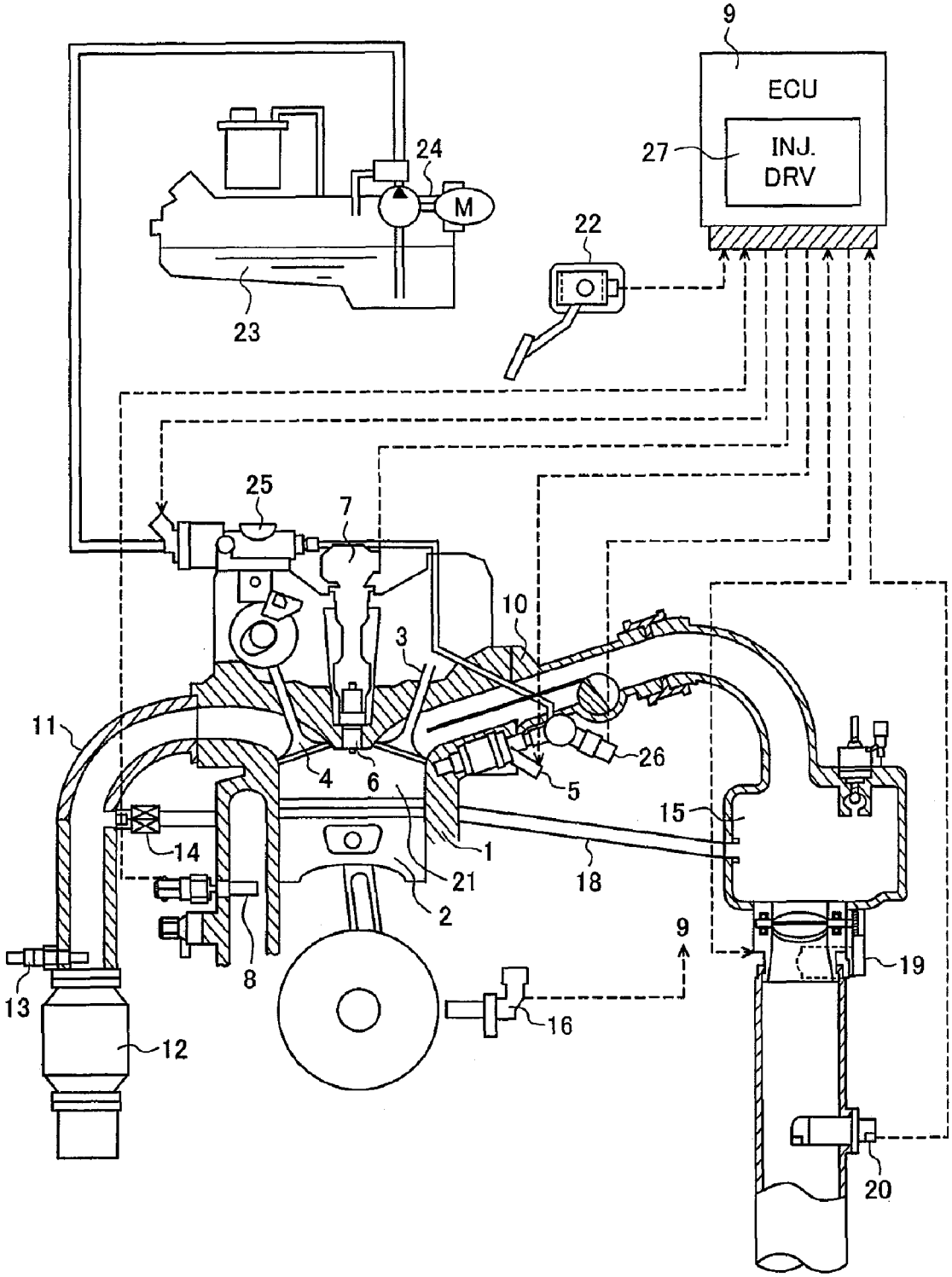
FIG. 1 is a block diagram of an internal combustion engine system having a fuel injection control apparatus of a first embodiment of the present invention.

First, a configuration of an internal combustion engine system with the fuel injection control apparatus of the present embodiment will be described using FIG. 1. FIG. 1 is a block diagram of the internal combustion engine system with the fuel injection control apparatus according to the first embodiment of the present invention.

The engine 1 includes a piston 2, an air suction valve 3, and an exhaust valve 4. Suction air flows into a throttle valve 19 through an air flowmeter (AFM) 20, and is supplied from a collector 15 that is a branch section, through an air suction pipe 10 and the suction valve 3, to a combustion chamber 21 of the engine 1. Fuel is supplied from a fuel tank 23 to the internal combustion engine by a low-pressure fuel pump 24, and the supplied fuel is boosted up to a pressure required for fuel injection, by a high-pressure fuel pump 25. The fuel that has been boosted by the high-pressure fuel pump 25 is injected from a fuel injector 5 into the combustion chamber 21 of the engine 1, and ignited by an ignition coil 7 and an ignition plug 6. The pressure of the fuel is measured by a fuel pressure sensor 26.

After-combustion gas emissions are discharged into an exhaust pipe 11 via the exhaust valve 4. The exhaust pipe 11 has a three-way catalyst 12 for cleaning the gas emissions. An engine control unit (ECU) 9 contains a fuel injection control apparatus 27. A signal from a crank angle sensor 16 of the engine 1, an air quantity signal from the AFM 20, a signal from an oxygen sensor 13 for detecting the concentration of oxygen in the gas emissions, an accelerator angle signal from an accelerator angle sensor 22, a signal from the fuel pressure sensor 26, and other signals are input to the fuel injection control apparatus 27. The ECU 9 conducts the calculation of a required engine torque based on the signal of the accelerator angle sensor 22 and judges whether the engine is in the idle state. In addition to a speed detector for computing the engine speed from the signal of the crank angle sensor 16, the ECU 9 further has a warm-up discriminator to judge whether the three-way catalyst 12 is in a warmed-up condition, by acquiring information such as engine water temperature information from a water temperature sensor 8, and information on the elapsed time from the start of the engine.

Besides, the ECU 9 calculates the quantity of suction air required for the engine 1, and outputs an appropriate angle signal to the throttle valve 19. Moreover, the ECU 9 activates the fuel injection control apparatus 27 to calculate a fuel quantity commensurate with the suction air quantity, output a fuel injection signal to the fuel injector 5, and output an ignition signal to the ignition plug 6.

An exhaust gas recirculation (EGR) pathway 18 connects the exhaust pipe 11 and the collector 15. An EGR valve 14 is provided midway on the EGR pathway 18. The opening angle of the EGR valve 14 is controlled by the ECU 9 so that the gas emissions in the exhaust pipe 11 are recirculated through the suction pipe 10 as necessary.

Next, the configuration of the fuel injection control apparatus according to the present embodiment will be described using FIG. 2.

Figure 2:
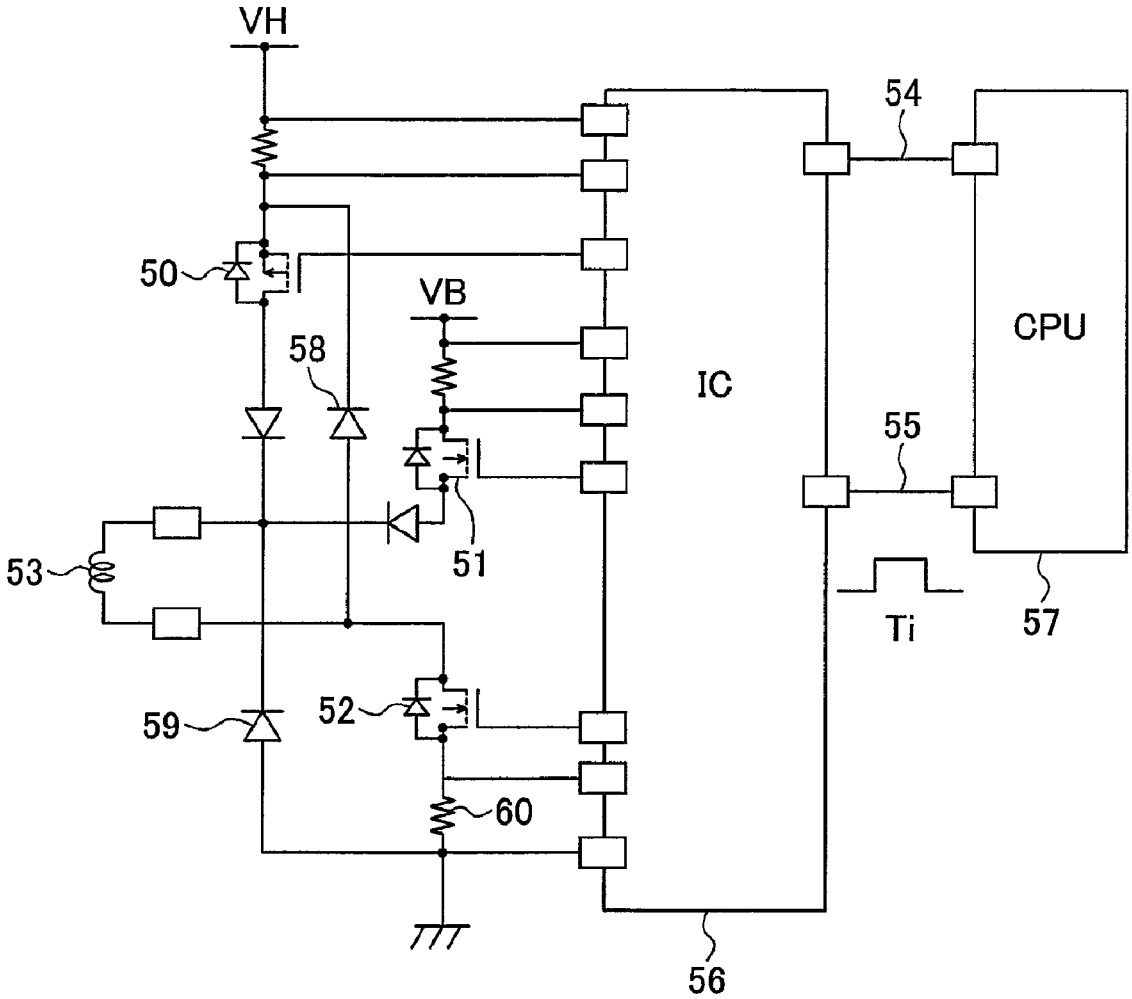
FIG. 2 is a circuit block diagram showing a configuration of the fuel injection control apparatus according to the first embodiment of the present invention.

FIG. 2 is a circuit block diagram showing the configuration of the fuel injection control apparatus according to the first embodiment of the present invention. The same reference numbers as used in FIG. 1 denote the same sections.

The fuel injection control apparatus 27 is typically contained in the ECU 9 shown in FIG. 1. A microcomputer (CPU) 57 computes an appropriate fuel injection pulse width and injection start timing according to an operational state of the internal combustion engine, and transmits a driving pulse Ti to a fuel injector driving IC 56 through a driving pulse transmission line 55. The driving IC that has received the driving pulse Ti conducts on/off switching of each of switching element 50, 51, and 52, and supplies an excitation current to the fuel injector 53.

The switching element 50 is connected between a high-voltage power supply VH and a high-voltage side terminal of the fuel injector 53. The high-voltage power supply VH is of 60 V, for example, and this voltage is generated by increasing a battery voltage using a DC/DC converter. The switching element 51 is connected between a low-voltage power supply LH and a high-voltage side terminal of the fuel injector 53. The low-voltage power supply LH is of 12.0 V, for example. The switching element 52 is connected between the low-voltage side terminal of the fuel injector 53 and grounding potential.

The driving IC 56 uses a current detection resistor 60 to detect the level of the current flowing through the injector 53, and switches the on/off states of the switching elements 50, 51, 52. Thus, a desired current level can be retained and power distributed.

Diodes 58 and 59 are provided to discharge the current that has flown into the fuel injector 53. The discharge is conducted rapidly by the diodes 58, 59 when the switching elements 51 and 52 are both off.

The driving IC 56 also exchanges data with the microcomputer 57 through a communications line 54. In accordance with the operational state of the intern-combustion engine, therefore, the microcomputer 57 can change the level of the current flowing into the injector 53, and a waveform of the current.

Next, the excitation current flowing into the injector 53 under control of the fuel injection control apparatus in the present embodiment is described below using FIG. 3.

Figure 3:
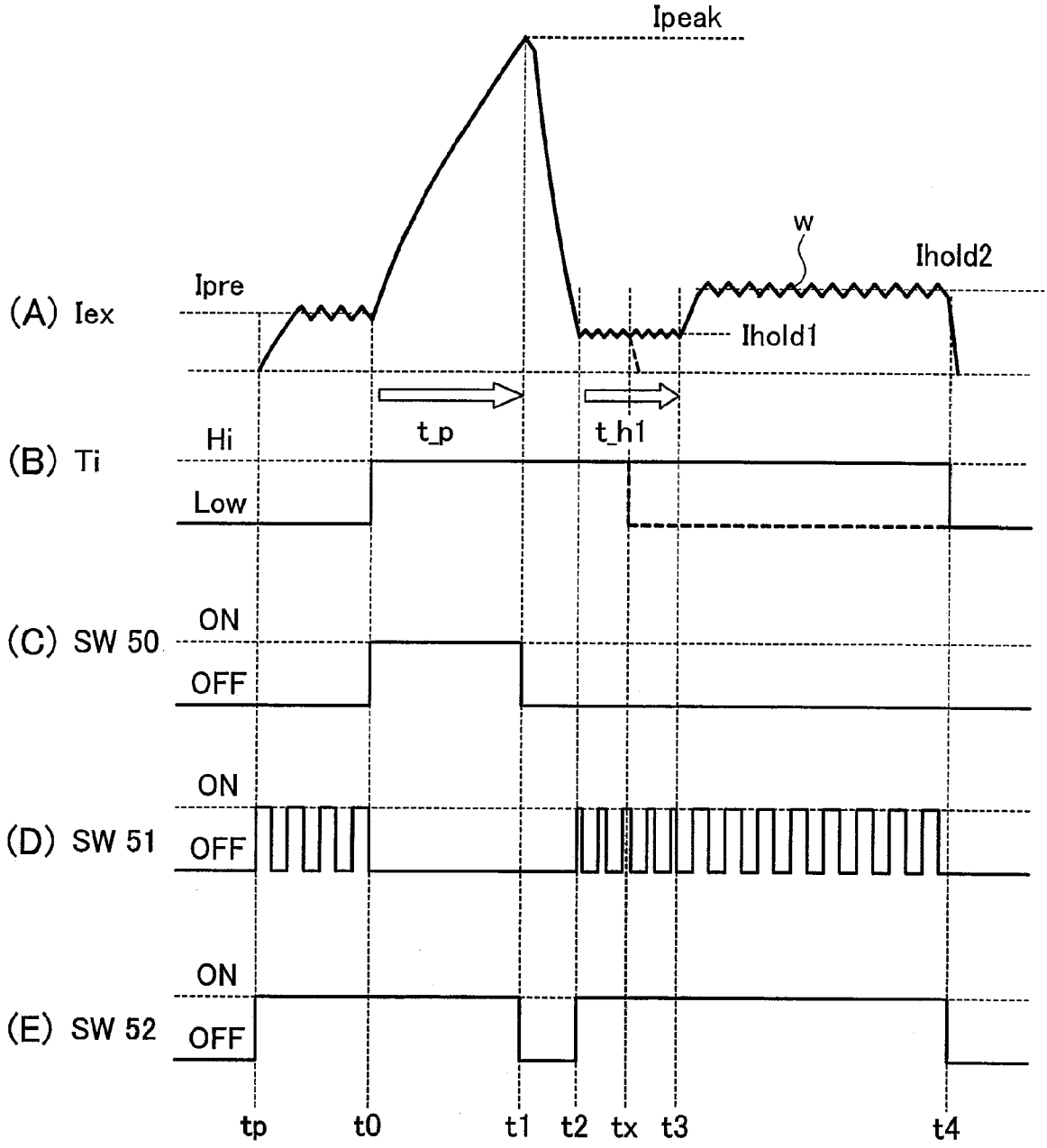
FIG. 3 is a timing chart showing an excitation current flowing into a fuel injector under control of the fuel injection control apparatus in the second embodiment of the present invention.

FIG. 3 is a timing chart showing the excitation current flowing into the injector 53 under the control of the fuel injection control apparatus in the second embodiment of the present invention.

In FIG. 3, the horizontal axes denote time "t". The vertical axis in section (A) of FIG. 3 denotes the excitation current Iex flowing into the fuel injector 53. The vertical axis in section (B) of FIG. 3 denotes the driving pulse Ti supplied from the microcomputer 57 to the driving IC 56. The vertical axis in section (C) of FIG. 3 denotes the on/off states of the switching element 50. The vertical axis in section (D) of FIG. 3 denotes the on/off states of the switching element 51. The vertical axis in section (E) of FIG. 3 denotes the on/off states of the switching element 52.

At time t0, before the driving pulse Ti shown in section (B) of FIG. 3 changes to a High (high) state, when a precharge current Ipre is to be supplied to the fuel injector 53 for a fixed time as shown in section (A) of FIG. 3, the driving IC 56 turns on the switching elements 51 and 52 during a tp-t0 time period, as shown in sections (D) and (E), respectively, of FIG. 3. At this time, voltage is applied from the low-voltage power supply LH to the injector 53 and the switching element 51 is turned on/off, whereby a desired level of the current Ipre is retained and power is distributed. The precharge current Ipre is about 1.5 A, for example.

The precharge current Ipre is maintained beforehand within such a current level range that keeps the valve of the fuel injector 53 open for a certain time. Time "t_p" from the rise of the driving pulse Ti to the arrival of the current at a valve-opening current level Ipeak, therefore, can be reduced by maintaining the precharge current level Ipre. This, in turn, allows a delay in valve opening of the injector 53 to be reduced.

At the time t0, in the fuel injection start timing that the microcomputer 57 has computed, the driving pulse Ti is transmitted to the driving IC 56, as shown in section (B) of FIG. 3. During the rise of the driving pulse signal Ti, the driving IC 56 turns on the switching elements 50 and 52 at the same time, as shown in sections (C) and (E) of FIG. 3, to supply the valve-opening current required for the injector 53 to open the valve rapidly. High voltage is applied from the high-voltage power supply 40 to the injector 53, thus causing the valve-opening current to be supplied thereto as shown in section (A) of FIG. 3.

At time t1, upon the arrival of the current at the desired level Ipeak in the timing shown in section (A) of FIG. 3, the driving IC 56 turns off the switching element 50 in the timing shown in section (C) of FIG. 3. The peak current Ipeak is 11 A, for example. At this time, the charge that has been applied to the injector circulates through the diode 59 and the injector 53, and energy of this charge is dissipated as heat. At the same time, as shown in section (E) of FIG. 3, the switching element 52 is also turned off, which returns the applied charge to the high-voltage power supply 40 via the diode 58 and reduces the charge rapidly.

At time t2, as shown in section (A) of FIG. 3, upon the approach of the current to such a first current level Ihold1 that does not permit the injector 53 to maintain the open state of the valve, the driving IC 56 turns on the switching elements 51, 52, as shown in sections (D) and (E) of FIG. 3, thus supplying a voltage from the low-voltage power supply LH to the injector 53. The switching element 51 is turned on and off for the current to be maintained at such first desired current level Ihold1 that does not permit the injector 53 to maintain the open state of the valve. The time during which the current is maintained at the first desired level Ihold1 is preset as a time "t_h1". For example, the first desired level Ihold1 is 1 A and the preset time "t_h1" is 0.2 ms.

The first desired current level Ihold1 and the preset time "t_h1" may both be changeable according to a particular operational state of the internal combustion engine, for example, the engine speed. The first desired current level Ihold1 may also be changeable according to a particular pressure of the fuel. In this case, the first desired current level Ihold1 is increased with an increase in the fuel pressure, and reduced with a decrease in the fuel pressure. The preset time "t_h1" may also be changeable according to a particular temperature of the fuel. In addition, the first desired current level Ihold1 and the preset time "t_h1" may both be changeable according to a particular concentration of alcohol in the fuel or to match the temperature of the fuel. Furthermore, the preset time "t_h1" has its upper limit provided to avoid valve closing that is liable to result if the first current level Ihold1 is retained for too long periods of time.

After a lapse of the preset time "t_h1", at time t3, the current is changed to a second desired current level Ihold2 at which the open state of the injector valve can be maintained. Similarly to the above, the switching element 51 is turned on and off, whereby the current is retained as shown in section (A) of FIG. 3. The second desired current level Ihold2 is, for example, 3 A. If the valve-opening current is maintained at the current level Ihold1, the valve will close since the injector will be unable to maintain the open state of the valve. This is why the current is changed to the second desired current level Ihold2 after the elapse of the preset time "t_h1".

The first hold current level Ihold1 is sufficiently lower than the second hold current level Ihold2 that is sufficient and necessary to maintain the valve open state of the injector. At the first hold current level Ihold1, the injector valve will close if the first hold current Ihold1 is maintained for a time longer than that actually required. A difference in absolute value between the first hold current Ihold1 and the second hold current Ihold2 is significant enough to accommodate such a change in current level that will be observed during the hold of the current (i.e., the current difference "w" shown in FIG. 3, for example).

At time t4, at an end of the fuel injection pulse width which has been computed by the microcomputer 57, the driving pulse Ti takes a Low level as shown in section (B) of FIG. 3, and the switching elements 50, 51, and 52 are all turned off to complete power distribution to the injector 53.

The illustrated example applies when the driving pulse width Ti is nearly 1.0 ms, for example. Also, the time t2 is reached after nearly 0.4 ms from the time t0, and the time t3 is reached after nearly 0.6 ms from the time t0.

For example, if the driving pulse Ti takes the Low level in the vicinity of time tx as denoted by a broken line in FIG. 3, the valve immediately closes at that time.

In this manner, the current, before being maintained at the second desired level Ihold2, is maintained at the first desired level Ihold1 lower than Ihold2 and disabling the open state of the valve to be maintained. Thus, the internal current of the injector 53 can be temporarily reduced. At the time tx, therefore, the injector 53 closes the valve immediately after power distribution thereto, and a delay in valve closing can be reduced, even when the driving pulse Ti is short.

Next, the excitation current flowing into the injector under the control of the fuel injection control apparatus in the present embodiment is described below using FIG. 4.

Figure 4:
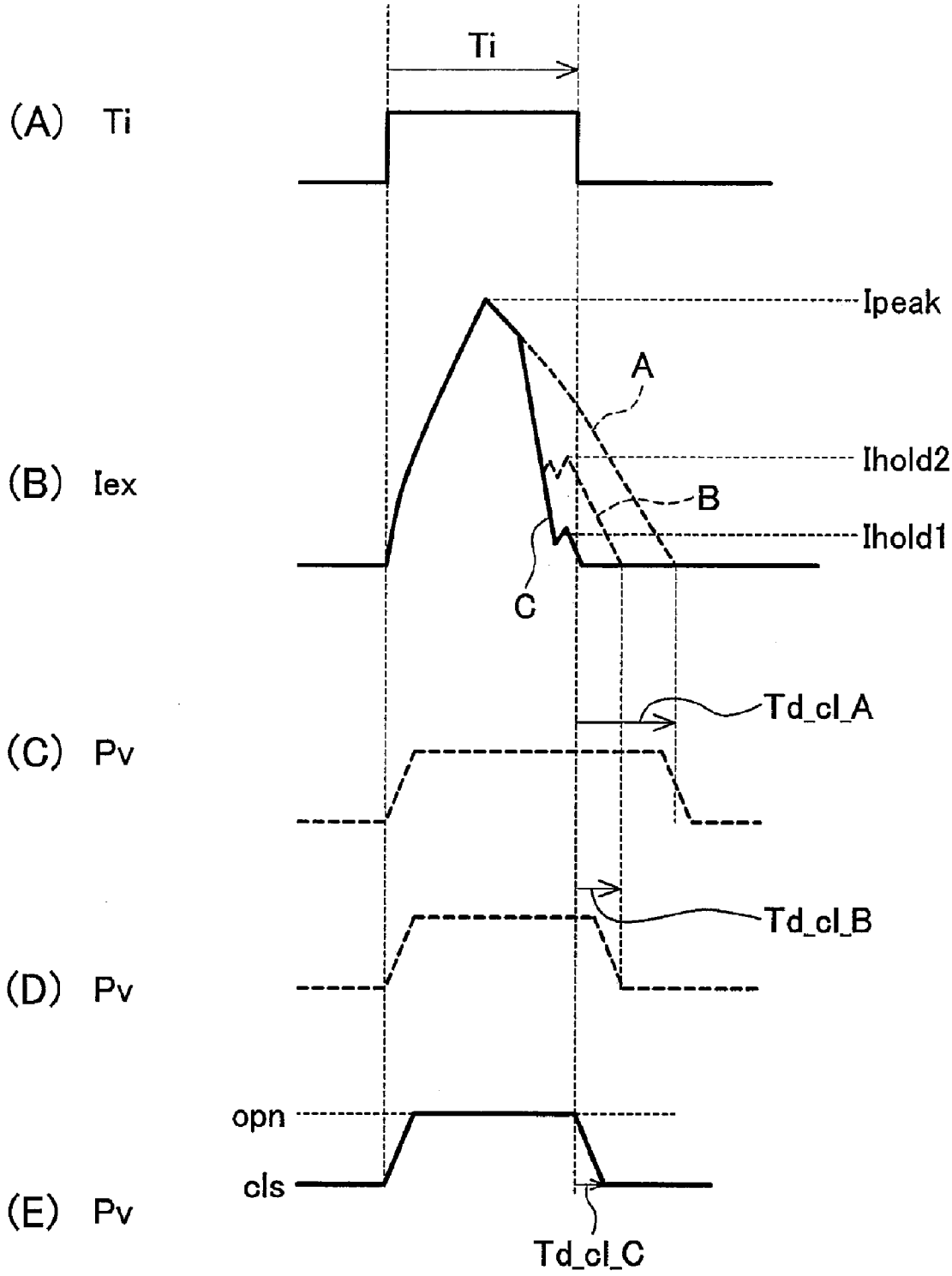
FIG. 4 is another timing chart showing the excitation current flowing into the fuel injector under the control of the fuel injection control apparatus in the first embodiment of the present invention.

FIG. 4 is another timing chart showing the excitation current flowing into the injector 53 under the control of the fuel injection control apparatus in the first embodiment of the present invention.

FIG. 4 shows the excitation current flowing into the injector 53 when the driving pulse Ti applied thereto is short, and associated opening and closing positions of the valve. The horizontal axes in FIG. 4 denote time. The vertical axis in section (A) of FIG. 4 denotes the driving pulse Ti. The vertical axis in section (B) of FIG. 4 denotes the excitation current Iex. The vertical axis in section (C) of FIG. 4 denotes as-driven valve positions of a conventional fuel injector. The vertical axis in section (D) of FIG. 4 denotes as-driven valve positions of another conventional fuel injector. The vertical axis in section (E) of FIG. 4 denotes as-driven valve positions of the fuel injector in the present embodiment.

In section (B) of FIG. 4, dotted line A indicates that after a start of supply of the valve-opening current Ipeak, the charge applied to the injector has been circulated through a diode 59 by turning a switching element 50 off to reduce the excitation current Iex. In this case, as shown in section (C) of FIG. 4, there has been a delay in timing from an arrival of the valve-opening current at a high level thereof to a fall of the current to a zero level, so there has been a limit about reducing a valve-closing delay Td_cl_A.

Broken line B in section (B) of FIG. 4 indicates that after a start of supply of the valve-opening current Ipeak, switching elements 50 and 52 have also been turned off at the same time to discharge the current rapidly and retain the current at a hold current level Ihold2. In this case, as shown in section (D) of FIG. 4, there has been a delay in timing from an arrival of the valve-opening current at a high level thereof to a fall of the current to a zero level, so there has been a limit about reducing a valve-closing delay Td_cl_B.

In contrast to the above, a solid line C in section (B) of FIG. 4 indicates that since, after the start of supply of the valve-opening current Ipeak, the current has been rapidly reduced to nearly a current level Ihold1 at which the valve open state cannot be retained, the delay up to the fall of the current to the zero level can be reduced significantly by stopping the supply current to the injector upon an arrival at the current level Ihold1. A valve-closing delay Td_cl_C existing when the driving pulse width is small, therefore, can be reduced in comparison with the delay in valve closing in the conventional injector.

Next, a relationship between the driving pulse Ti to the injector during the control of the fuel injection control apparatus in the present embodiment, and the quantity of fuel injection from the injector, is described below using FIG. 5.

Figure 5:
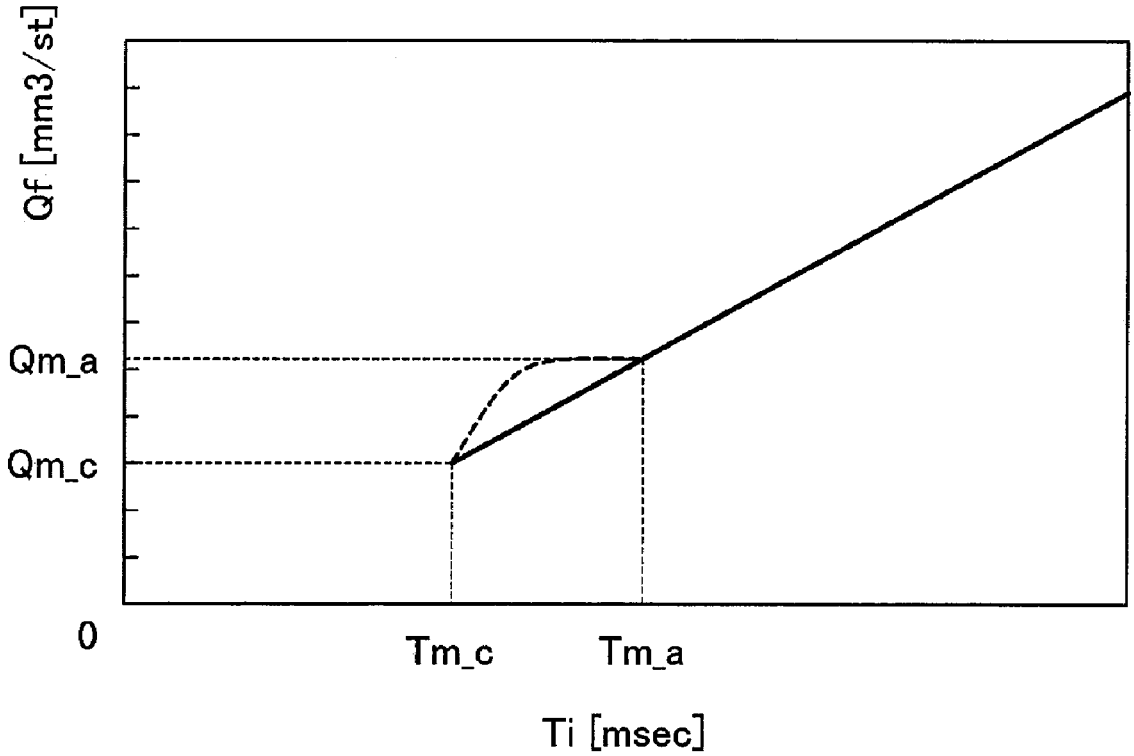
FIG. 5 is a diagram illustrating a relationship between a driving pulse to the fuel injector during the control of the fuel injection control apparatus in the first embodiment of the present invention, and the quantity of fuel injection from the injector.

FIG. 5 is a diagram explaining the relationship between the driving pulse Ti to the injector during the control of the fuel injection control apparatus in the first embodiment of the present invention, and the quantity of fuel injection from the injector.

Referring to FIG. 5, a horizontal axis denotes the driving pulse Ti to the injector, and a vertical axis denotes the fuel injection quantity Qf from the injector. Also, a broken line in the figure indicates characteristics of a conventional fuel injector.

In conventional techniques, for the retention of the hold current level following the start of supply of the valve-opening current, when the driving pulse width Ti is in a pulse width region of Tm_a or less, the delay in valve closing increases the fuel injection quantity Qf and hence, nonlinearity, as denoted by the broken line in the figure. Accordingly, the driving pulse Ti has traditionally needed to be used in a region larger than the pulse width Tm_a. The injection quantity at this time has been Qm_a, the minimum quantity of injection from the injector. The pulse width Tm_a is, for example, 0.6 ms, and the associated quantity of fuel injection has been, for example, 5 $mm^3$/st (stroke).

In contrast to this, in the method of the present embodiment, since the delay in valve closing in the injector can be reduced, the region where the linear relationship between the driving pulse Ti and the injection quantity is maintained expands to a low-pulse side. This allows minimum injection pulse width to be reduced to Tm_c and the minimum injection quantity to be reduced to Qm_c. The pulse width Tm_c is, for example, 0.4 ms, and the fuel injection quantity Qm_c is, for example, 3 $mm^3$/st (stroke). That is to say, in the present embodiment, the minimum injection quantity can be reduced from Qm_a to Qm_c without changing the injector, so a dynamic range of injection quantities can be improved.

The fuel injection control method of the present embodiment, shown in FIG. 3, is used in a relatively narrow pulse-width region. In other words, the current signal waveform shown in FIG. 3 is selected for a driving pulse width Ti greater than the time period t_p shown in FIG. 3, and not allowing the driving pulse—injection quantity linear relationship to be obtained for such a current signal waveform as described later herein using FIG. 6. For example, the region where the fuel injection control method shown in FIG. 3 is used is either a region having a driving pulse Ti equal to or less than the pulse width Tm_a, or a region having a pulse width Ti slightly larger than or less than the pulse width Tm_a. For example, the fuel injection control method described later herein using FIG. 6 is used in a driving pulse width region wider than either of the above regions.

The current signal waveforms that have been illustrated and described above take effect when applied to the case that the driving pulse Ti to the injector is small.

Next, the excitation current flowing into the injector under the control of the fuel injection control apparatus in the present embodiment when the injector driving pulse width is large is described below using FIG. 6. FIG. 6 is yet another timing chart showing the excitation current flowing into the injector 53 under the control of the fuel injection control apparatus in the first embodiment of the present invention when the injector driving pulse width is large.

Figure 6:
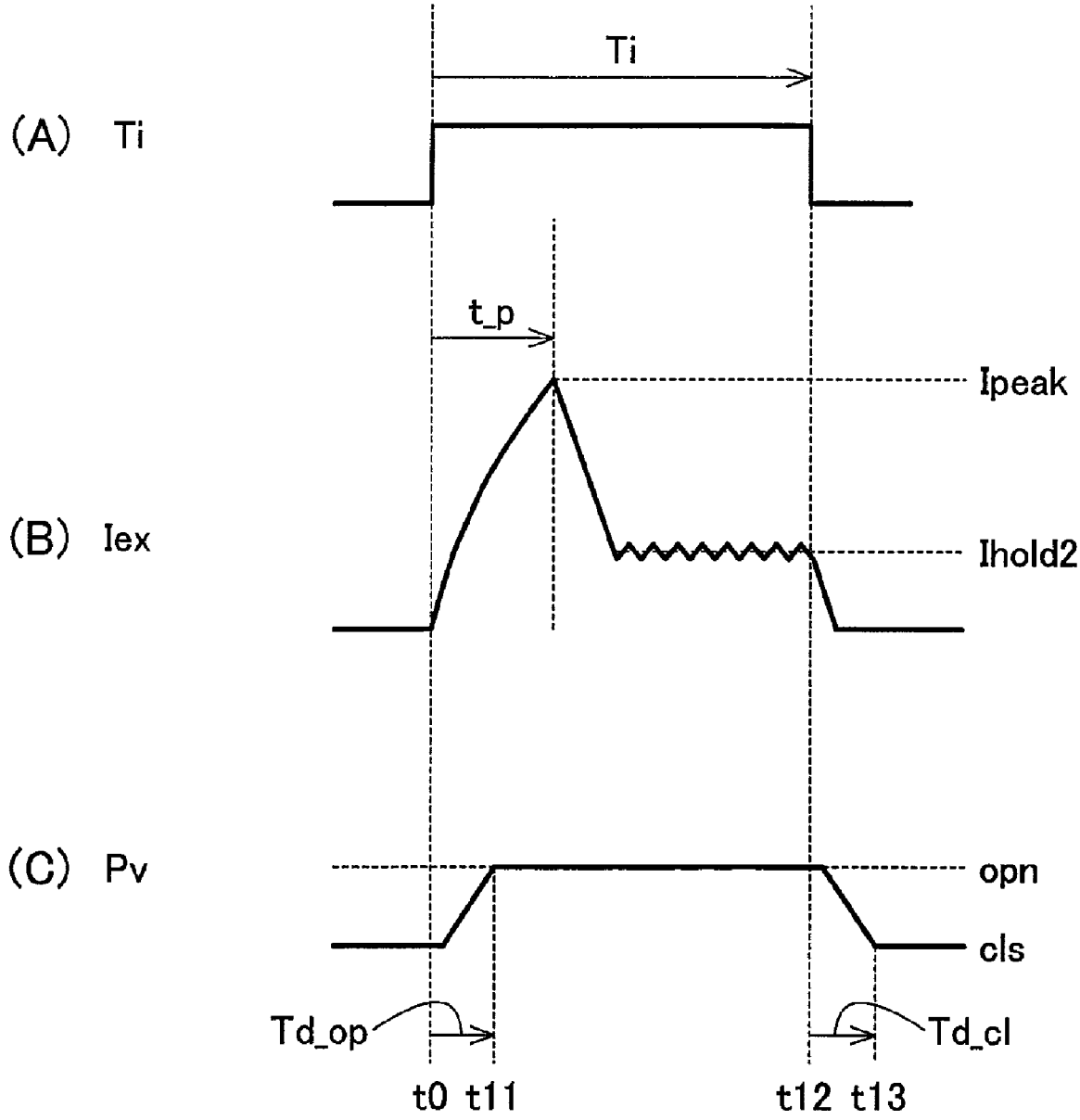
FIG. 6 is yet another timing chart showing the excitation current flowing into the fuel injector under the control of the fuel injection control apparatus in the first embodiment of the present invention when width of the injector driving pulse is large.

FIG. 6 shows the excitation current flowing into the injector when the driving pulse Ti applied thereto is wide, and associated opening and closing positions of the valve. A horizontal axis in FIG. 6 denotes time. A vertical axis in section (A) of FIG. 6 denotes the driving pulse Ti. A vertical axis in section (B) of FIG. 6 denotes the excitation current Iex. A vertical axis in section (C) of FIG. 6 denotes as-driven valve positions of the fuel injector in the present embodiment.

As shown in section (A) of FIG. 6, at time t0, the driving pulse Ti is transmitted to the driving IC 56 in the fuel injection start timing that the microcomputer 57 has computed. During the rise of the driving pulse signal Ti, the driving IC 56 turns on the switching elements 50 and 52 at the same time to supply the valve-opening current required for the injector 53 to open the valve rapidly, as shown in section (B) of FIG. 6. High voltage is applied from the high-voltage power supply 40 to the injector 53, thus causing the valve-opening current to be supplied thereto.

As shown in section (B) of FIG. 6, at time t11, upon the arrival of the current at the desired level Ipeak, the driving IC 56 turns off the switching element 50. The peak current Ipeak is 11 A, for example. At this time, the charge that has been applied to the injector circulates through the diode 59 and the injector 53, and energy of this charge is dissipated as heat.

At time t12, upon the approach of the current to the second current level Ihold2 that permits the injector 53 to maintain the open state of the valve, the driving IC 56 turns on the switching elements 51, 52, thus supplying the voltage from the low-voltage power supply LH to the injector 53. The switching element 51 is turned on and off for the current to be maintained at such second desired current level Ihold2 that permit the injector 53 to maintain the open state of the valve. For example, the second desired level Ihold2 is 3 A.

At time t13, at an end of the fuel injection pulse width which has been computed by the microcomputer 57, the driving pulse Ti takes a Low level to turn off the switching elements 50, 51, and 52, thus completing power distribution to the injector 53.

Next, the method of control by the fuel injection control apparatus in the present embodiment is described below using FIG. 7.

Figure 7:
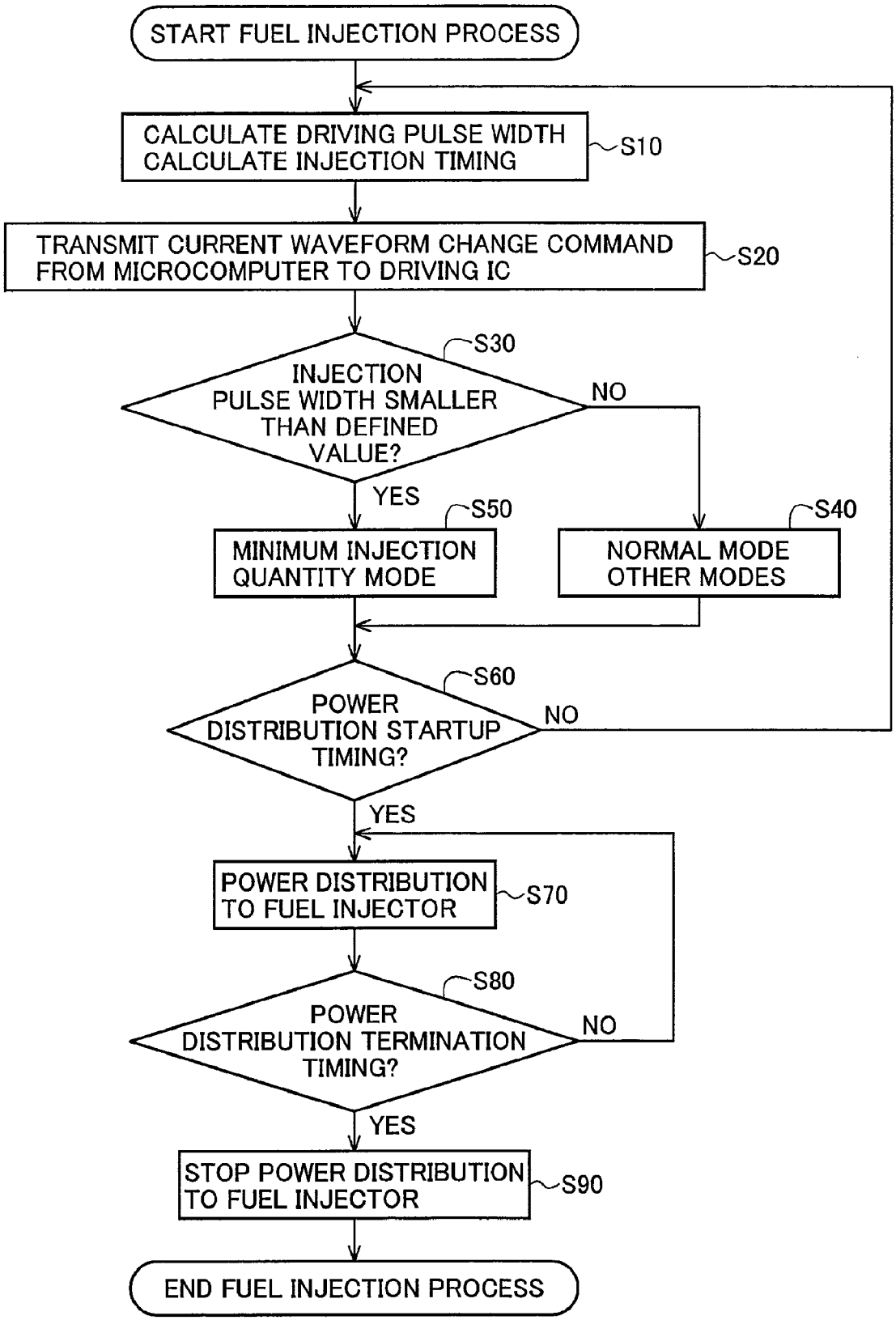
FIG. 7 is a flowchart showing a method of fuel injector control by the fuel injection control apparatus in the first embodiment of the present invention.

FIG. 7 is a flowchart showing the method of control by the fuel injection control apparatus in the first embodiment of the present invention.

During internal combustion engine operation, in step S10, the ECU 9 computes the width of the driving pulse Ti to the fuel injector, and the injection timing.

Next in step S20, the microcomputer 57 transmits a current signal waveform changing command to the driving IC 56 of the injector.

Next in step S30, the microcomputer 57 judges whether the driving pulse width that was computed in step S10 is equal to or more than a predetermined value. If the computed driving pulse width is equal to or more than the predetermined value, a current signal waveform is assigned that is associated with the normal mode described in FIG. 6. If the computed driving pulse width is less than the predetermined value, a current signal waveform associated with the minimum injection quantity described in FIG. 3 is assigned as a minimum injection quantity mode.

After that, the microcomputer 57 judges whether the timing in which the distribution of electric power to the injector is to be started has arrived. Process control is returned to step S10 if the power distribution start timing is not reached.

Upon the arrival at the power distribution start timing, the microcomputer 57 transmits the driving pulse Ti to the driving IC 56 in step S70. The driving IC 56 then supplies the excitation current to the injector in accordance with the current signal waveform that was set in step S40 or S50.

In step S80, the microcomputer 57 judges whether the timing in which the distribution of electric power to the injector is to be terminated has arrived. In step S90, power distribution from the driving IC 56 to the injector is terminated simultaneously with the end of the driving pulse Ti.

As described above, in the present embodiment, when the driving pulse Ti to the injector is small and the fall of this pulse signal from Hi to Low occurs in the interval of t_h1, power distribution to the injector is stopped at nearly the current level Ihold1. In the present embodiment, since the arrival at the valve-opening current level Ipeak is followed by rapid reduction of the current for a decrease to nearly the current level Ihold1 at which the open state of the valve cannot be retained, the delay up to the fall of the current level to 0 after power distribution to the injector has been stopped can be reduced very significantly. Hence, the valve-closing delay Td_cl_C can be made smaller than in conventional techniques.

Reducing significantly in this way the current level obtained during the end of power distribution to the fuel injector lessens the internal residual charge of the circuit, reducing the valve-closing delay, and avoiding any increases in minimum injection quantity due to the valve-closing delay. Accurate injection of a small quantity of fuel with a minimum valve-closing delay can be achieved without reducing the maximum injection quantity.

A configuration and operation of a fuel injection control apparatus according to a first embodiment of the present invention will be described hereunder using FIG. 8. A configuration of an internal combustion engine system with the fuel injection control apparatus of the present embodiment is substantially the same as in FIG. 1. Also, the configuration of the fuel injection control apparatus according to the present embodiment is substantially the same as in FIG. 2. In addition, a method of fuel injector control by the fuel injection control apparatus according to the present embodiment is substantially the same as in FIG. 7.

Figure 8:
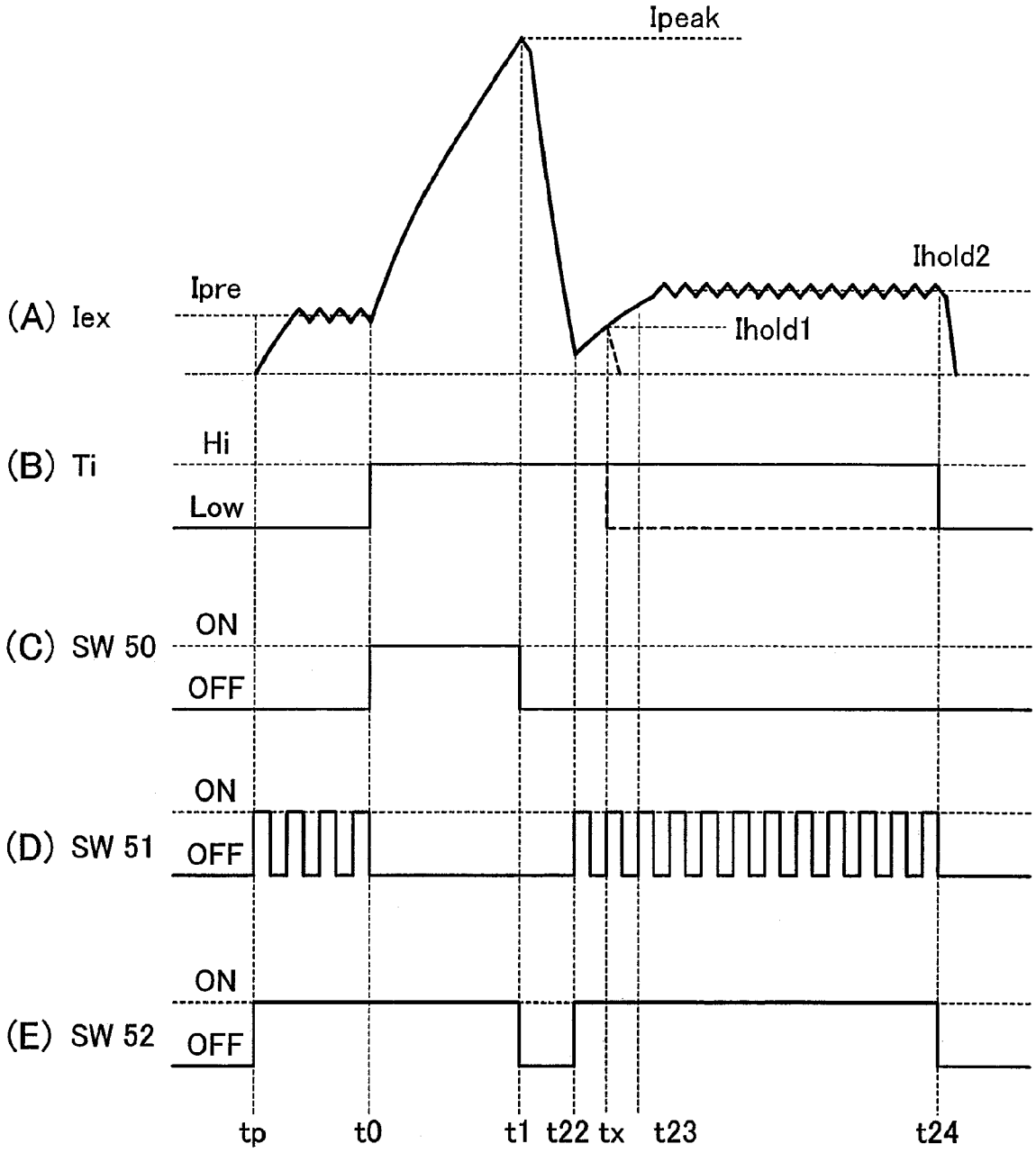
FIG. 8 is a timing chart showing the excitation current flowing into the fuel injector under control of a fuel injection control apparatus in a first embodiment of the present invention.

FIG. 8 is a timing chart showing the excitation current flowing into the injector under the control of the fuel injection control apparatus in the first embodiment of the present invention.

In FIG. 8, a horizontal axis denotes time "t". A vertical axis in section (A) of FIG. 8 denotes the excitation current Iex flowing into the fuel injector 53. A vertical axis in section (B) of FIG. 8 denotes the driving pulse Ti supplied from the microcomputer 57 to the driving IC 56. A vertical axis in section (C) of FIG. 8 denotes the on/off states of the switching element 50. A vertical axis in section (D) of FIG. 8 denotes the on/off states of the switching element 51. A vertical axis in section (E) of FIG. 8 denotes the on/off states of the switching element 52.

At time t0, before the driving pulse Ti changes to the Hi state, when the precharge current Ipre is to be supplied to the fuel injector 53 for a fixed time as shown in section (A) of FIG. 8, the driving IC 56 turns on the switching elements 51 and 52 during a tp-t0 time period, as shown in sections (D) and (E), respectively, of FIG. 8. At this time, voltage is applied from the low-voltage power supply LH to the injector and the switching element 51 is turned on/off, whereby, as shown in section (A) of FIG. 8, a desired level of the current Ipre is retained and power is distributed. The precharge current Ipre is about 1.5 A, for example.

The precharge current Ipre is maintained beforehand within such a current level range that keeps the valve of the fuel injector 53 open for a certain time. Time from a rise of the driving pulse Ti to an arrival of the current at a valve-opening current level Ipeak, therefore, can be reduced by maintaining the precharge current level Ipre. This, in turn, allows a delay in valve opening of the injector 53 to be lessened.

At the time t0, in the fuel injection start timing that the microcomputer 57 has computed, the driving pulse Ti is transmitted to the driving IC 56, as shown in section (B) of FIG. 8. During the rise of the driving pulse signal Ti, the driving IC 56 turns on the switching elements 50 and 52 at the same time, as shown in sections (C) and (E) of FIG. 8, to supply the valve-opening current required for the injector 53 to open the valve rapidly. High voltage is applied from the high-voltage power supply 40 to the injector 53, thus causing the valve-opening current to be supplied thereto as shown in section (A) of FIG. 8.

At time t1, upon the arrival of the current at the desired level Ipeak in the timing shown in section (A) of FIG. 8, the driving IC 56 turns off the switching element 50 in the timing shown in section (C) of FIG. 8. The peak current Ipeak is 11 A, for example. At this time, the charge that has been applied to the injector circulates through the diode 59 and the injector 53, and energy of this charge is dissipated as heat. At the same time, as shown in section (E) of FIG. 8, the switching element 52 is also turned off, which returns the applied charge to the high-voltage power supply 40 via the diode 58 and reduces the charge rapidly.

At time t22, as shown in section (A) of FIG. 8, upon an arrival of the current to such a current level Ihold1 that does not permit the injector 53 to maintain the open state of the valve, the driving IC 56 turns on the switching elements 51, 52, as shown in sections (D) and (E) of FIG. 8, thus supplying a voltage from the low-voltage power supply LH to the injector 53.

At time t23, as shown in section (A) of FIG. 8, upon an arrival of the current to a second desired current level Ihold2 at which the injector 53 can maintain the open state of the valve, the driving IC 56 turns on and off the switching element 51 to retain the current.

The current level Ihold1 is a current value sufficiently smaller than the second hold current Ihold2 that is sufficient and necessary to maintain the valve open state of the injector.

At time t24, at an end of the fuel injection pulse width which has been computed by the microcomputer 57, the driving pulse Ti takes a Low level as shown in section (B) of FIG. 8, and the switching elements 50, 51, and 52 are all turned off to complete power distribution to the injector 53.

The illustrated example applies when the driving pulse width Ti is nearly 1.0 ms, for example. Also, the time t22 is reached after nearly 0.4 ms from the time t0, and the time t23 is reached after nearly 0.6 ms from the time t0.

For example, if the driving pulse Ti takes the Low level in the vicinity of time tx as denoted by a broken line in FIG. 8, the valve immediately closes at that time.

In this manner, the current, before being maintained at the second desired level Ihold2, is maintained at the first desired level Ihold1 lower than Ihold2 and disabling the open state of the valve to be maintained. Thus, the internal current of the injector 53 can be temporarily reduced. At the time tx, therefore, the injector 53 closes the valve immediately after power distribution thereto, and a delay in valve closing can be reduced, even when the driving pulse Ti is short.

As described above, in the present embodiment, when the driving pulse Ti to the injector is small and the fall of this pulse signal from Hi to Low occurs in the t22-t23 time interval, power distribution to the injector is stopped at nearly the current level Ihold1. In the present embodiment, since the arrival at the valve-opening current level Ipeak is followed by rapid reduction of the current for a decrease to nearly the current level Ihold1 at which the open state of the valve cannot be retained, the delay up to the fall of the current level to 0 after power distribution to the injector has been stopped can be reduced very significantly. Hence, the valve-closing delay Td_cl_C can be made smaller than in conventional techniques.

Reducing significantly in this way the current level obtained during the end of power distribution to the fuel injector lessens the internal residual charge of the circuit, reducing the valve-closing delay, and avoiding any increases in minimum injection quantity due to the valve-closing delay. Accurate injection of a small quantity of fuel with a minimum valve-closing delay can be achieved without reducing the maximum injection quantity.

A configuration and operation of a fuel injection control apparatus according to a third embodiment of the present invention will be described hereunder using FIG. 9. A configuration of an internal combustion engine system with the fuel injection control apparatus of the present embodiment is substantially the same as in FIG. 1. Also, the configuration of the fuel injection control apparatus according to the present embodiment is substantially the same as in FIG. 2.

Figure 9:
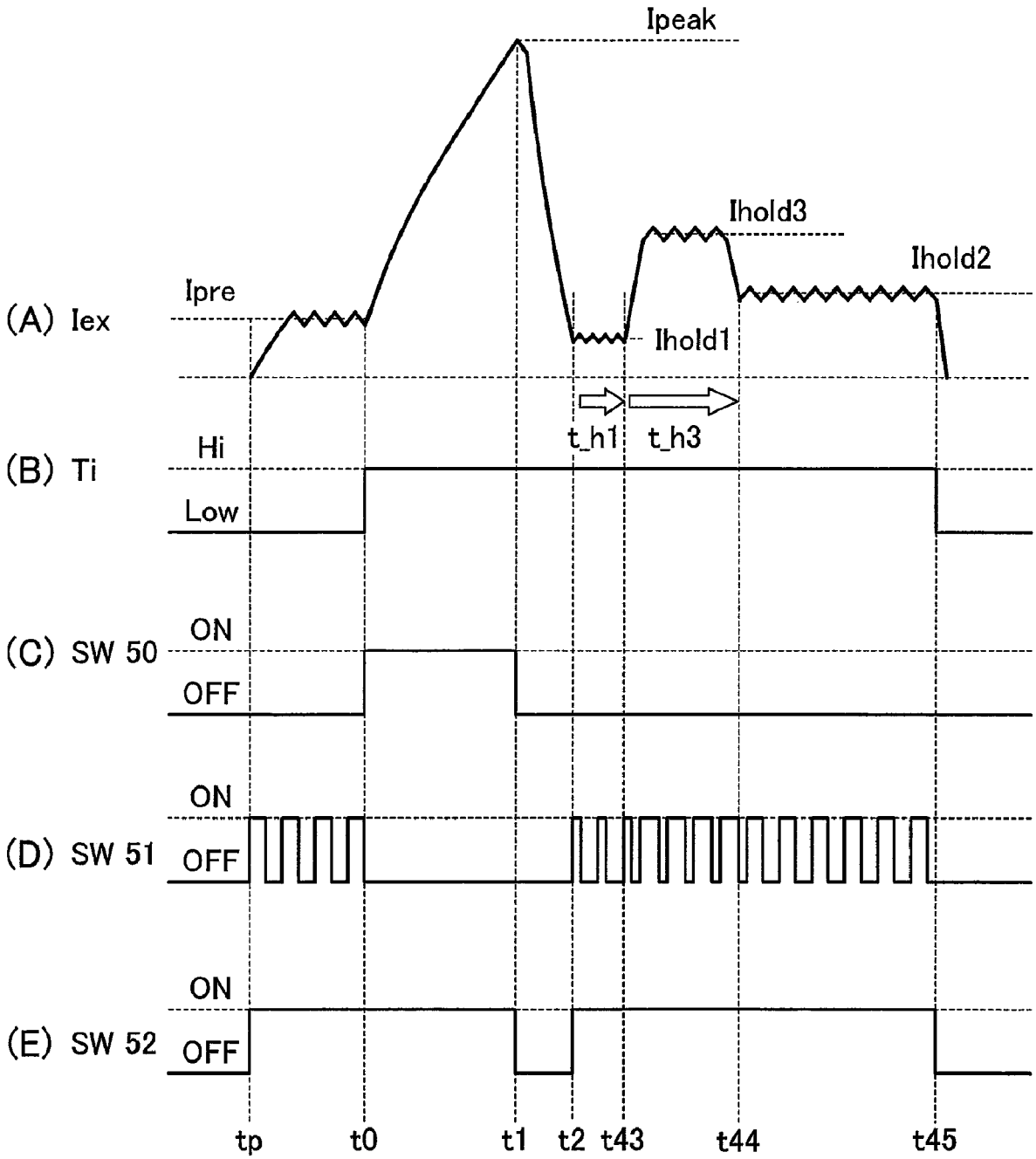
FIG. 9 is a timing chart showing the excitation current flowing into the fuel injector under control of a fuel injection control apparatus in a third embodiment of the present invention.

FIG. 9 is a timing chart showing the excitation current flowing into the injector under the control of the fuel injection control apparatus in the third embodiment of the present invention.

The present embodiment, unlike those shown in FIGS. 3 and 8, can dispense with mode switching in steps S30-S50 of FIG. 7.

At time t0, before the driving pulse Ti shown in section (B) of FIG. 9 changes to a High (high) state, when the precharge current Ipre is to be supplied to the fuel injector 53 for a fixed time as shown in section (A) of FIG. 9, the driving IC 56 turns on the switching elements 51 and 52 during a tp-t0 time period, as shown in sections (D) and (E), respectively, of FIG. 9. At this time, voltage is applied from the low-voltage power supply LH to the injector 53 and the switching element 51 is turned on/off, whereby a desired level of the current Ipre is retained and power is distributed. The precharge current Ipre is about 1.5 A, for example.

The precharge current Ipre is maintained beforehand within such a current level range that keeps the valve of the fuel injector 53 open for a certain time. Time from a rise of the driving pulse Ti to an arrival of the current at a valve-opening current level Ipeak, therefore, can be reduced by maintaining the precharge current level Ipre. This, in turn, allows a delay in valve opening of the injector 53 to be lessened.

At the time t0, in the fuel injection start timing that the microcomputer 57 has computed, the driving pulse Ti is transmitted to the driving IC 56, as shown in section (B) of FIG. 9. During the rise of the driving pulse signal Ti, the driving IC 56 turns on the switching elements 50 and 52 at the same time, as shown in sections (C) and (E) of FIG. 9, to supply the valve-opening current required for the injector 53 to open the valve rapidly. High voltage is applied from the high-voltage power supply 40 to the injector 53, thus causing the valve-opening current to be supplied thereto as shown in section (A) of FIG. 9.

At time t1, upon the arrival of the current at the desired level Ipeak in the timing shown in section (A) of FIG. 9, the driving IC 56 turns off the switching element 50 in the timing shown in section (C) of FIG. 9. The peak current Ipeak is 11 A, for example. At this time, the charge that has been applied to the injector circulates through the diode 59 and the injector 53, and energy of this charge is dissipated as heat. At the same time, as shown in section (E) of FIG. 9, the switching element 52 is also turned off, which returns the applied charge to the high-voltage power supply 40 via the diode 58 and reduces the charge rapidly.

At time t2, as shown in section (A) of FIG. 9, upon an approach of the current to such a first current level Ihold1 that does not permit the injector 53 to maintain the open state of the valve, the driving IC 56 turns on the switching elements 51, 52, as shown in sections (D) and (E) of FIG. 9, thus supplying a voltage from the low-voltage power supply LH to the injector 53. The switching element 51 is turned on and off for the current to be maintained at such first desired current level Ihold1 that does not permit the injector 53 to maintain the open state of the valve. The time during which the current is maintained at the first desired level Ihold1 is preset as a time "t_h1". For example, the first desired level Ihold1 is 1 A and the preset time "t_h1" is 0.1 ms.

After a lapse of the preset time "t_h1", at time t43, the current is changed to a third desired current level Ihold3 higher than the second desired current level Ihold2 at which the open state of the injector valve can be maintained. Similarly to the above, the switching element 51 is turned on and off, whereby the current is retained as shown in section (A) of FIG. 9. The third desired current level Ihold3 is 6 A, for example. If the valve-opening current remains maintained at the current level Ihold1, the valve will close since the injector will be unable to maintain the open state of the valve. Additionally, maintaining the valve-opening current at the current level Ihold1 will reduce energy of the injector. For these reasons, the injector is recharged with energy by the change of the current to the third desired current level Ihold3 higher than the second desired current level Ihold2 the second desired current level Ihold2 after the elapse of the preset time "t_h1".

After a lapse of a preset time "t_h2", at time t44, the current is changed to the second desired current level Ihold2 at which the open state of the injector valve can be maintained. Similarly to the above, the switching element 51 is turned on and off, whereby the current is retained as shown in section (A) of FIG. 9. The second desired current level Ihold2 is 3 A, for example.

The first hold current level Ihold1 is sufficiently lower than the second hold current level Ihold2 that is sufficient and necessary to maintain the valve open state of the injector. At the first hold current level Ihold1, the injector valve will close if the first hold current Ihold1 is maintained for a time longer than that actually required.

At time t45, at the end of the fuel injection pulse width which has been computed by the microcomputer 57, the driving pulse Ti takes a Low level as shown in section (B) of FIG. 9, and the switching elements 50, 51, and 52 are all turned off to complete power distribution to the injector 53.

The illustrated example applies when the driving pulse width Ti is nearly 1.0 ms, for example. Also, the time t2 is reached after nearly 0.4 ms from the time t0, and the time t43 is reached after nearly 0.6 ms from the time t0.

For example, if the driving pulse Ti takes the Low level in the vicinity of time t_h1 in FIG. 9, the valve immediately closes at that time.

In this manner, the current, before being maintained at the second desired level Ihold2, is maintained at the first desired level Ihold1 lower than Ihold2 and disabling the open state of the valve to be maintained. Thus, the internal current of the injector 53 can be temporarily reduced. At the time t_h1, therefore, the injector 53 closes the valve immediately after power distribution thereto, and a delay in valve closing can be reduced, even when the driving pulse Ti is short.

In the above example, the time "t_h1" during which the current will be maintained at the current level Ihold1 not allowing the valve open state of the injector to be retained is set to equal a time at which the valve does not completely close. After this time, the current is retained at the current level Ihold3 higher than Ihold2 at which the valve open state can be retained, and then the current is reduced to and retained at the hold current Ihold2. Assigning this current signal waveform compensates for a decrease in valve-open state maintaining force at the current level Ihold1, thus allowing the injector to maintain the valve open state without closing the valve midway, even at normal pulse width Ti. In addition, control that switches the current signal waveform with each change in valve-opening pulse width Ti becomes unnecessary.

As described above, in the present embodiment, when the driving pulse Ti to the injector is small and the fall of this pulse signal from Hi to Low occurs in the "t_h1" time interval, power distribution to the injector is stopped at nearly the current level Ihold1. In the present embodiment, since the arrival at the valve-opening current level Ipeak is followed by rapid reduction of the current for a decrease to nearly the current level Ihold1 at which the open state of the valve cannot be retained, the delay up to the fall of the current level to 0 after power distribution to the injector has been stopped can be reduced very significantly. Hence, the valve-closing delay Td_cl_C can be made smaller than in conventional techniques.

Reducing significantly in this way the current level obtained during the end of power distribution to the fuel injector lessens the internal residual charge of the circuit, reducing the valve-closing delay, and avoiding any increases in minimum injection quantity due to the valve-closing delay. Accurate injection of a small quantity of fuel with a minimum valve-closing delay can be achieved without reducing the maximum injection quantity.

In addition, control that switches the current signal waveform with each change in valve-opening pulse width Ti becomes unnecessary.

What is claimed is:

1. A fuel injection control apparatus of an internal combustion engine for supplying electric current from a high-voltage power supply to a fuel injector in order to open a valve of the injector, then, after opening the valve, switching the high-voltage power supply to a low-voltage power supply, and retaining the open state of the valve, the control apparatus comprising:

control means for controlling the current supplied to the fuel injector such that, after the current is supplied from the high-voltage power supply to the fuel injector to open the valve of the injector, the current is rapidly discharged to reduce the current to a first current incapable of keeping the valve open, the first current is supplied during a predetermined period, and a second current capable of keeping the valve open is then supplied to the fuel injector.

2. A fuel injection control apparatus of an internal combustion engine for supplying electric current from a high-voltage power supply to a fuel injector in order to open a valve of the injector, then, after opening the valve, switching the high-voltage power supply to a low-voltage power supply, and retaining the open state of the valve, the control apparatus comprising:

control means for controlling the current supplied to the fuel injector such that, after the current is supplied from the high-voltage power supply to the fuel injector to open the valve of the injector, the current is rapidly discharged to reduce the current to a first current incapable of keeping the valve open, the first current is supplied during a predetermined period, and the control means retains a third current higher than a current capable of keeping the valve open for a predetermined amount of time and then supplies the second current capable of keeping the valve open.

* * * * *